US008777700B2

(12) United States Patent
Michiyoshi et al.

(10) Patent No.: US 8,777,700 B2
(45) Date of Patent: Jul. 15, 2014

(54) SCATTERING PREVENTION STRUCTURE OF GRINDING MACHINE

(75) Inventors: Kazunori Michiyoshi, Toyama (JP); Kazuya Kogura, Toyama (JP)

(73) Assignee: Komatsu NTC Ltd., Toyama (JP)

( * ) Notice: Subject to any disclaimer, the term of this patent is extended or adjusted under 35 U.S.C. 154(b) by 0 days.

(21) Appl. No.: 13/997,090

(22) PCT Filed: Dec. 21, 2011

(86) PCT No.: PCT/JP2011/079724

§ 371 (c)(1),
(2), (4) Date: Jun. 21, 2013

(87) PCT Pub. No.: WO2012/086726

PCT Pub. Date: Jun. 28, 2012

(65) Prior Publication Data

US 2013/0280993 A1 Oct. 24, 2013

(30) Foreign Application Priority Data

Dec. 24, 2010 (JP) ..... 2010-286978

(51) Int. Cl.
*B24B 55/04* (2006.01)

(52) U.S. Cl.
CPC ..... *B24B 55/04* (2013.01)
USPC ..... 451/455; 451/451

(58) Field of Classification Search
CPC ..... B24B 55/04; B24B 55/06; B24B 5/42
USPC ..... 451/455, 454, 451, 452
See application file for complete search history.

(56) References Cited

U.S. PATENT DOCUMENTS 3,564,780 A * 2/1971 Grzymek et al. ..... 451/452
3,824,890 A * 7/1974 Zettler et al. ..... 409/134
7,300,339 B2 11/2007 Gaul et al.

(Continued)

FOREIGN PATENT DOCUMENTS

CN 1951629 A 4/2007
CN 201385259 Y 1/2010

(Continued)

OTHER PUBLICATIONS

Chinese Office Action for Patent Application No. 201180062318, mailed Jan. 13, 2014 for the corresponding Chinese patent application.

(Continued)

*Primary Examiner* — Robert Rose
(74) *Attorney, Agent, or Firm* — Capitol City TechLaw

(57) ABSTRACT

This scattering prevention structure of a grinding machine has: a pair of supporting tables; an X axis saddle, which supports a grinding head such that the grinding head can freely move in the advancing/retracing direction with respect to a workpiece; a Z axis saddle, which supports the X axis saddle such that the X axis saddle can freely move in the rotating axis direction of the workpiece; and a grinding stone cover. The grinding stone cover is fixed to the Z axis saddle such that the grinding stone cover opens in a machining region, and the grinding stone head can freely move, with respect to the grinding stone cover, in the advancing/retracting direction with respect to the workpiece, by having the accordion cover therebetween. With this configuration, the size of the machining chamber is reduced, and shielding performance is improved.

6 Claims, 4 Drawing Sheets

(56) References Cited

U.S. PATENT DOCUMENTS

| | | | | |
|---|---|---|---|---|
| 8,460,066 | B2 * | 6/2013 | Araki et al. | 451/242 |
| 2005/0020197 | A1 | 1/2005 | Wakazono | |
| 2013/0130603 | A1 * | 5/2013 | Andersson et al. | 451/451 |

FOREIGN PATENT DOCUMENTS

| | | | |
|---|---|---|---|
| JP | 2000288932 | A | 10/2000 |
| JP | 2000354964 | A | 12/2000 |
| JP | 2003117828 | A | 4/2003 |
| JP | 2005040892 | A | 2/2005 |

OTHER PUBLICATIONS

International Search Report for corresponding PCT Application No. PCT/JP2011/079724, Feb. 21, 2012.

* cited by examiner

SCATTERING PREVENTION STRUCTURE OF GRINDING MACHINE

TECHNICAL FIELD

The present invention relates to the scattering prevention structure of a grinding machine, and in particular, to the scattering prevention structure of the grinding machine having devices which biaxially feed a grinding stone table.

BACKGROUND ART

Up until now, scattering prevention devices such as accordion covers, telescopic covers, and winding covers have been used to shield a machining region from a non-machining region since ground powder and coolant (hereinafter collectively referred to as "grinding fluid") are scattered in the machining region of a grinding machine (e.g., Patent Literatures 1 and 2).

In addition, such a grinding machine includes devices which biaxially move a grinding stone in the axial direction and the advancing/retracting direction with respect to a workpiece to adapt to the long workpiece. Therefore, the grinding machine employs a scattering prevention structure in which a machining chamber is divided into, e.g., the two pieces of front side space and rear side space, an accordion cover and a telescopic cover are used as uniaxial scattering prevention covers moved in the rotating axis direction of the workpiece, and a sliding seal member is disposed as a cover member to move the grinding stone in the advancing/retracting direction with respect to the workpiece.

PRIOR ART REFERENCE

Patent Literature

Patent Literature 1: JP 2003-117828 A
Patent Literature 2: JP 2000-354964 A

SUMMARY OF THE INVENTION

Problems to be Solved by the Invention

However, in grinding apparatuses described in Patent Literatures 1 and 2, a grinding stone table is installed inside the machining chamber, and a grinding stone head moves inside the machining chamber. Therefore, there has been concern that the size of the machining chamber is increased and the adverse effects of heat are caused by the retention of heated grinding fluid.

In addition, in a case in which the accordion cover and the telescopic cover are used as the uniaxial scattering prevention covers moved in the rotating axis direction of the workpiece and the sliding seal member is disposed as the cover member to move the grinding stone in the advancing/retracting direction with respect to the workpiece, the scattering prevention structure becomes complex due to a large number of sliding parts, which results in a reduction in the shielding performance and the sealing performance.

The present invention has been made in view of the above circumstances and has an object of providing the scattering prevention structure of a grinding machine that reduces the size of a machining chamber, in which grinding fluid is scattered, with a simple configuration and that improves the shielding performance while preventing the adverse effects of heat.

Means for Solving the Problem

The invention according to claim 1 of the present invention provides a scattering prevention structure that covers a machining region of a grinding machine having a pair of supporting tables that is disposed facing each other and rotatably supports a workpiece, a grinding stone table having a grinding stone head that rotatably supports a grinding stone, an X axis saddle that movably supports the grinding stone table along an advancing/retracting direction with respect to the workpiece, a Z axis saddle that movably supports the X axis saddle along a rotating axis direction of the workpiece, and a grinding stone cover that covers the grinding stone. The scattering prevention structure includes a first fixing cover and a second fixing cover that are respectively attached to the supporting tables; a Z axis shielding cover that shields the first fixing cover, the second fixing cover, and the grinding stone cover one from another and has the grinding stone cover attached thereto such that the grinding stone cover is movable in the rotating axis direction of the workpiece; and an X axis shielding cover that is attached to the grinding stone cover such that the grinding stone head having the grinding stone attached thereto fits in the X axis shielding cover, shields the grinding stone head and the grinding stone cover one from the other, and has the grinding stone head attached thereto such that the grinding stone head is movable in the advancing/retracting direction with respect to the workpiece, wherein the machining region is covered by the first fixing cover, the second fixing cover, and the Z axis shielding cover to form a machining chamber, the grinding stone cover is fixed to the Z axis saddle such that the grinding stone cover opens into the machining chamber, and the grinding stone head is movable relative to the grinding stone cover via the X axis shielding cover in the advancing/retracting direction with respect to the workpiece.

In the scattering prevention structure according to claim 1 of the present invention, the first fixing cover and the second fixing cover are attached to the respective supporting tables on the sides where the pair of supporting tables faces each other, and the Z axis shielding cover is disposed that shields the first fixing cover, the second fixing cover, and the grinding stone cover (i.e., grinding stone housing) one from another. Thus, with a simple configuration using the first fixing cover, the second fixing cover, and the Z axis shielding cover, the scattering prevention structure can define the machining region only at the peripheral region of the workpiece. Therefore, the scattering prevention structure can reduce the size of the machining chamber.

In addition, in the scattering prevention structure according to claim 1 of the present invention, the grinding stone table is supported by the X axis saddle, the X axis saddle is supported by the Z axis saddle, and the grinding stone cover is separated from the X axis saddle and fixed to the Z axis saddle. Thus, the grinding stone head is movable relative to the grinding stone cover via the X axis shielding cover in the advancing/retracting direction (X axis direction) with respect to the workpiece. Therefore, the scattering prevention structure can move only the grinding stone into the machining region of the workpiece without moving the grinding stone cover in the X axis direction. Accordingly, since the scattering prevention structure is not required to move the grinding stone head into the machining region, it can improve the shielding performance and reduce the size of the machining chamber.

Moreover, in the scattering prevention structure according to claim 1 of the present invention, the X axis shielding cover is disposed that is attached to the grinding stone cover such that the grinding stone head fits in the X axis shielding cover, shields the grinding stone head and the grinding stone cover one from the other, and has the grinding stone head attached thereto such that the grinding stone head is movable in the advancing/retracting direction with respect to the workpiece. Thus, the X axis shielding cover is disposed separately from the Z axis shielding cover. Therefore, the scattering prevention structure can improve the shielding performance in the X axis direction without hindering the movement of the grinding stone head while preventing the interference between the X axis shielding cover and the grinding stone or the like.

Thus, the scattering prevention structure of the grinding machine according to claim 1 of the present invention can be suitably applied to the grinding machine that reduces the size of the machining chamber, in which the grinding fluid is scattered, with the simple configuration, improves the shielding performance while preventing the adverse effects of heat, and has devices which biaxially feed the grinding stone.

The invention according to claim 2 of the present invention provides the scattering prevention structure described in claim 1, wherein the X axis shielding cover is an accordion cover.

According to this configuration, the accordion cover shields the grinding stone head and the grinding stone cover one from the other. Thus, the interference is prevented with the simple configuration, and the shielding performance can be further improved without hindering the movement of the grinding stone head.

The invention according to claim 3 of the present invention provides the scattering prevention structure described in claim 1 or 2, wherein the Z axis shielding cover is a fixing cover made of a flat plate.

According to the configuration, the fixing cover made of the flat plate is employed and does not expand and contract unlike an accordion. Therefore, swarf is prevented from being caught, and a stain due to adhered coolant is small. As a result, the durability of the cover can be improved.

The invention according to claim 4 of the present invention provides the scattering prevention structure described in any one of claims 1 to 3, wherein the grinding stone cover has a sizing device attached thereto, the sizing device measuring a grinding portion of the workpiece.

According to the configuration, the sizing device is attached to the grinding stone cover. Thus, the sizing device is not moved together with the grinding stone head independently of the movement of the grinding stone head in the advancing/retracting direction with respect to the workpiece, but can be moved together with the grinding stone head only along the rotating axis direction of the workpiece. Therefore, a device that moves the sizing device in the Z axis direction is not required to be disposed, and the configuration can be simplified.

The invention according to claim 5 of the present invention provides the scattering prevention structure described in claim 4, wherein the scattering prevention structure includes moving means for reciprocating the sizing device in the advancing/retracting direction with respect to the workpiece.

According to this configuration, there is disposed the moving means for reciprocating the sizing device attached to the grinding stone cover in the advancing/retracting direction with respect to the workpiece. Thus, even if there is an interference part that protrudes beyond the diameter to be measured of the workpiece, the sizing device is retracted so as to be distant from the workpiece by an operation irrespective of the grinding stone head, thereby making it possible to prevent the interference.

Effect of the Invention

The scattering prevention structure of the grinding machine according to the present invention can be suitably applied to a grinding machine that reduces the size of a machining chamber, in which coolant is scattered, with a simple configuration, improves the shielding performance while preventing the adverse effects of heat, prevents the interference between a shielding cover and a grinding stone or the like, and has devices which biaxially feed the grinding stone.

EMBODIMENTS FOR CARRYING OUT THE INVENTION

Figure 1:
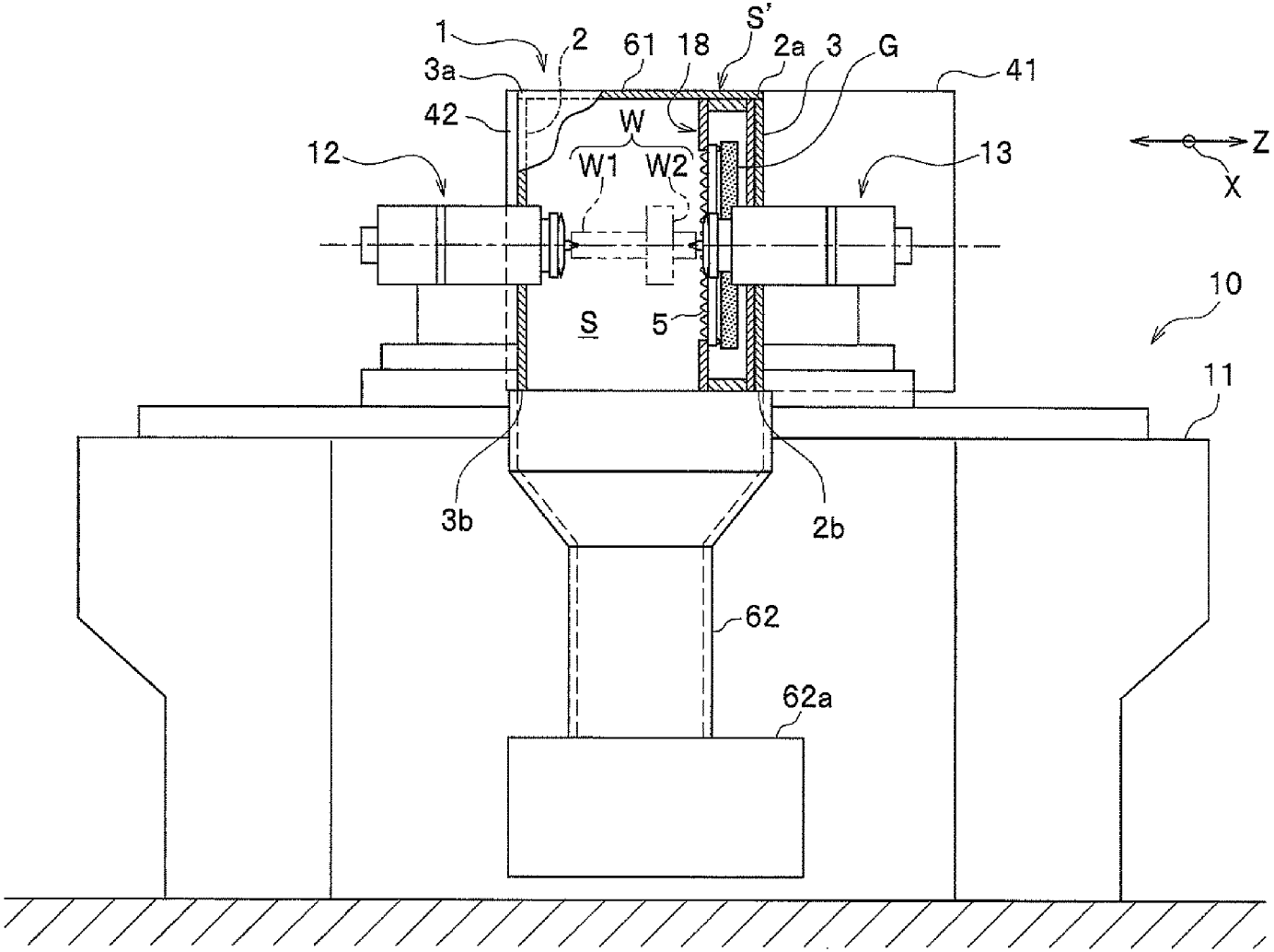
FIG. 1 is a front view showing the configuration of the scattering prevention structure of a grinding machine according to embodiments of the present invention.
Figure 2:
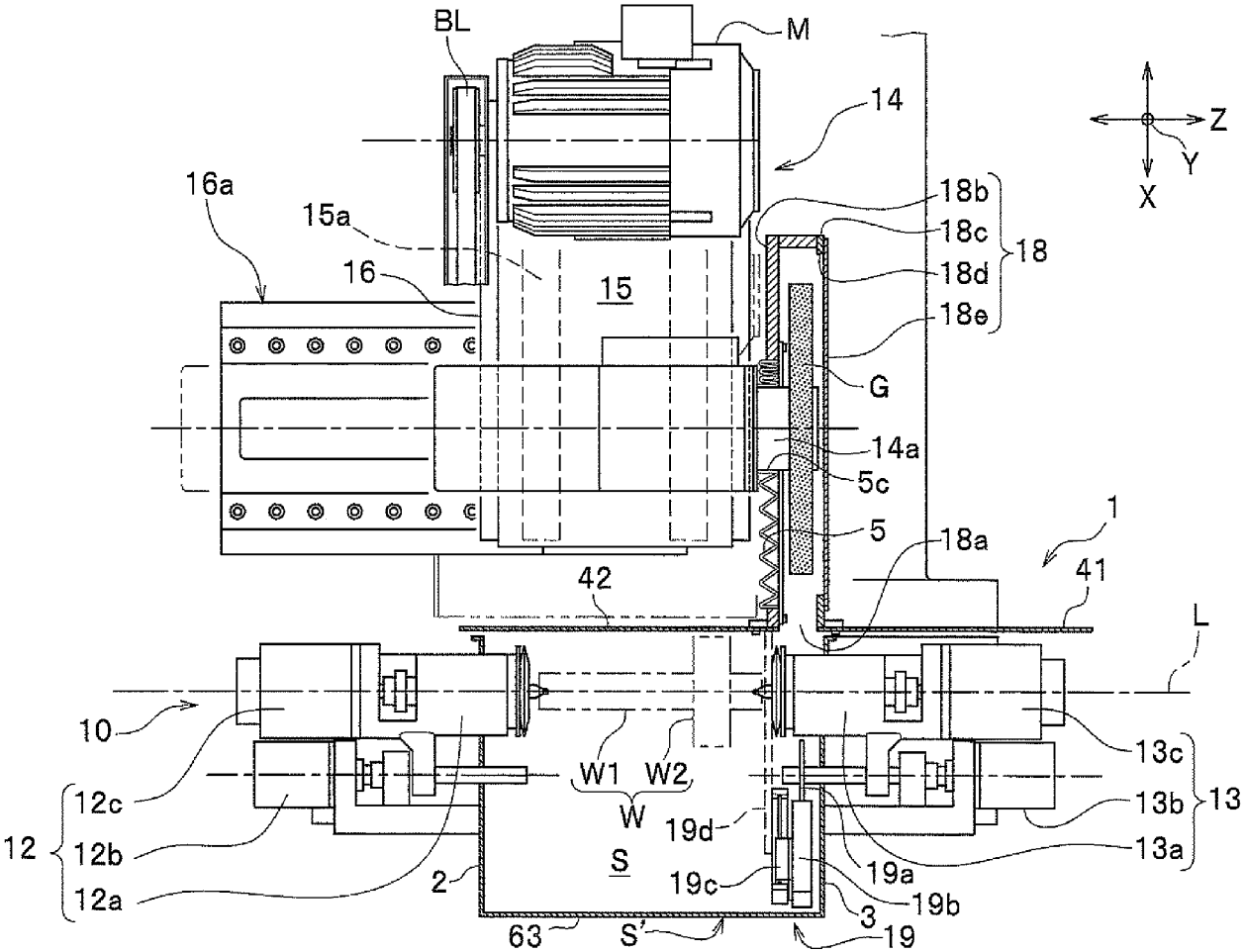
FIG. 2 is a partial plan view of FIG. 1 for describing a machining region in the scattering prevention structure according to the embodiments of the present invention.
Figure 3:
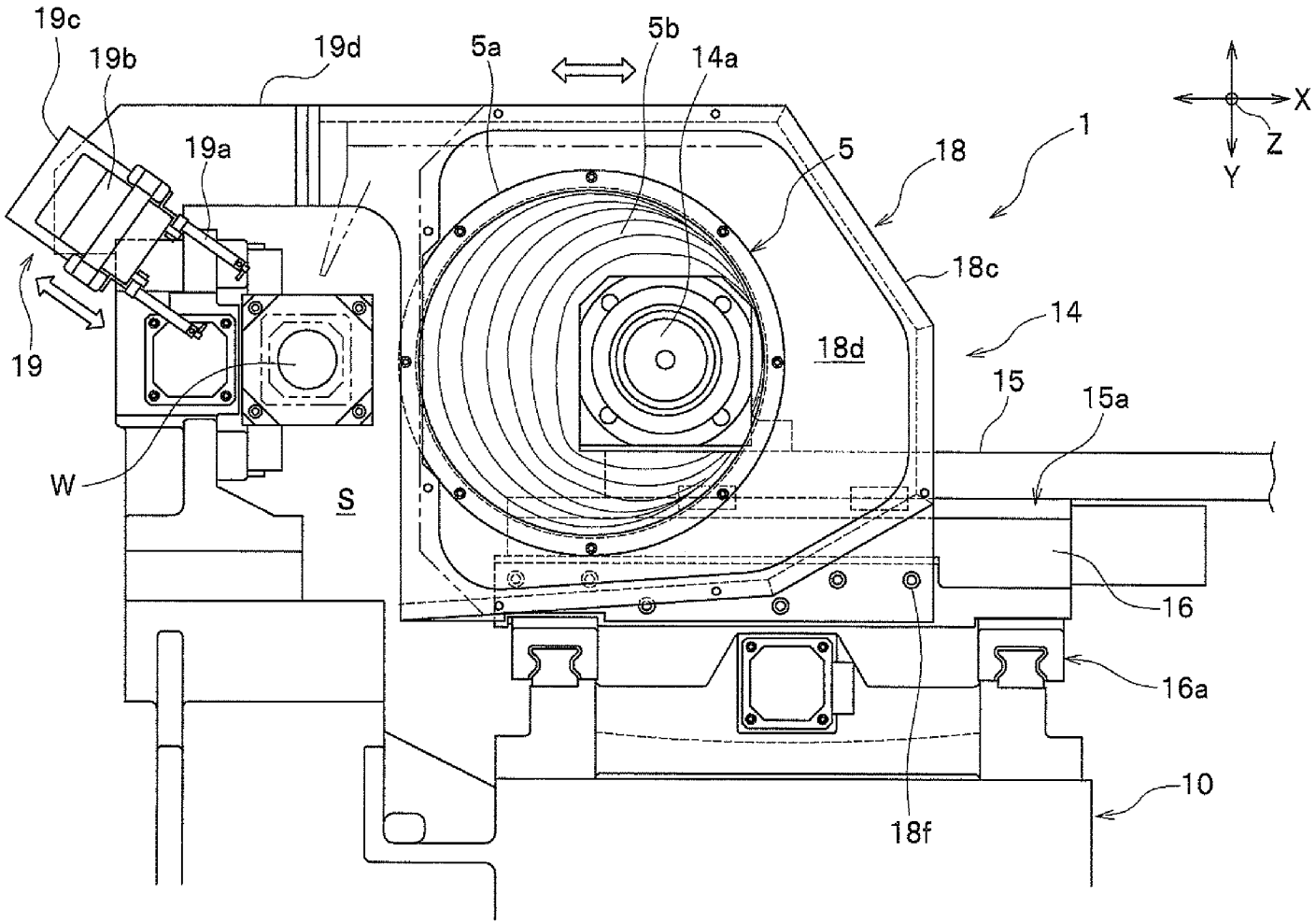
FIG. 3 is a partial side view of FIG. 1 for describing the machining region in the scattering prevention structure according to the embodiments of the present invention.

Referring to FIGS. 1 to 3 as required, a description will be given in detail of a scattering prevention structure 1 of a horizontal grinding machine 10 (see FIG. 1) according to embodiments of the present invention. Note that for the sake of convenience, a sizing device 19 (see FIG. 2) is omitted to describe the main configuration of the grinding machine 10 in FIG. 1, and a grinding stone G is removed from a grinding stone heat 14*a* in FIG. 3.

As shown in FIGS. 1 to 3, the grinding machine 10 according to the embodiments of the present invention includes a main axis table 12 and a tailstock 13 that serve as a pair of supporting tables; a grinding stone table 14 (see FIG. 3) that rotatably supports the grinding stone G; an X axis saddle 15 (see FIG. 3) that supports the grinding stone table 14; an X axis feeding device 15*a* that moves the X axis saddle 15 along an advancing/retracting direction (X axis direction) with respect to a workpiece W; a Z axis saddle 16 (see FIG. 3) that supports the X axis saddle 15; a Z axis feeding device 16*a* that moves the Z axis saddle 16 along the rotating axis direction (Z axis direction) of the workpiece W; a grinding stone cover 18 (see FIG. 1) that covers the grinding stone G; the sizing device 19 (see FIG. 2) that measures a grinding portion W1 of the workpiece W; and moving means 19*c* for reciprocating the sizing device 19 in the advancing/retracting direction with respect to the workpiece W.

Note that for the sake of convenience, the horizontal direction that serves as the direction of the rotating axis L of the workpiece W is indicated as the Z axis direction (axis line direction of the main axis), the cross direction that serves as the advancing/retracting direction in which advancing/retracting operations are performed with respect to the workpiece W is indicated as the X axis direction, and the up and down direction orthogonal to the X and Y axes is indicated as the Y axis direction in the grinding machine 10 according to the embodiments of the present invention.

The scattering prevention structure 1 according to the embodiments of the present invention forms a machining chamber S' defined and attached so as to cover a machining region S of the grinding machine 10 (FIG. 1) and includes a left side surface cover 2 that serves as a first fixing cover; a right side surface cover 3 that serves as a second fixing cover; a Z axis shielding cover 4 that shields the left side surface cover 2, the right side surface cover 3, and the grinding stone cover 18 one from another; an accordion cover 5 that serves as an X axis shielding cover to shield the grinding stone head 14*a* and the grinding stone cover 18 one from the other; an upper cover 61 that covers the upper part of the machining region S; a lower cover 62 disposed under the machining region S; and a sliding door 63 (see FIG. 2) that shields the front surface of the machining region S so as to be openable and closable.

The main axis table 12 and the tailstock 13 are disposed facing each other on a bed 11 and rotatably support the workpiece W.

As shown in FIG. 1, the main axis table 12 is disposed on the bed 11 on the left side with respect to the workpiece W when seen from the front. Further, as shown in FIG. 2, the main axis table 12 includes a workpiece supporting part 12*a* pivotally supported in the axis line direction of the main axis so as to be movable, a moving mechanism 12*b* that moves the workpiece supporting part 12*a* in the axis line direction of the main axis, and a motor 12*c* that rotates and drives the workpiece W (see FIG. 3).

As shown in FIG. 1, the tailstock 13 is disposed facing the main axis table 12 so as to support the other end of the workpiece W on the bed 11 on the right side with respect to the workpiece W when seen from the front. Further, as shown in FIG. 2, the tailstock 13 includes a workpiece supporting part 13*a* pivotally supported in the axis line direction of the main axis so as to be movable, a moving mechanism 13*b* that moves the workpiece supporting part 13*a* in the axis line direction of the main axis, and a motor 13*c* that rotates and drives the workpiece W.

With this configuration, the main axis table 12 and the tailstock 13 centrally support and drive the workpiece W and rotatably support the same about the axis line of the main axis. In addition, since the workpiece supporting parts 12*a* and 13*a* are movably journaled along the axis line direction of the main axis, they can suitably support the long workpiece W.

Note that in the embodiments, the main axis table 12 and the tailstock 13 have the same configuration and rotate the workpiece W in the held state. Alternatively, the tailstock 13 may be driven to rotate by the motor 12*c* that rotates and drives the workpiece W provided in the main axis table 12, or the main axis table 12 may be provided with a chucking member to hold the workpiece W.

The left side surface cover 2 is a thin-plate-shaped cover member that causes the workpiece supporting part 12*a* of the main axis table 12 to be slidably inserted therein and is mounted on the bed 11 by fastening tools such as bolts, and is disposed along the orthogonal direction so as to cross the direction of the rotating axis L of the workpiece W. With this configuration, the left side surface cover 2 is disposed on the left side part of the machining region S in FIG. 1 and shields a driving mechanism such as the motor 12*c* vulnerable to the intrusion of grinding fluid from the machining region S.

The right side surface cover 3 is a thin-plate-shaped cover member that causes the workpiece supporting part 13*a* of the tailstock 13 to be slidably inserted therein and is mounted on the bed 11 by fastening tools such as bolts, and is disposed along the orthogonal direction so as to cross the direction of the rotating axis L of the workpiece W. The right side surface cover 3 shields the left side part of the machining region S in FIG. 1.

As shown in FIG. 1, the upper cover 61 is a thin-plate-shaped cover member that is disposed on the left side surface cover 2 and the right side surface cover 3 and shields the upper part of the machining region S. Further, the upper cover 61 is joined to upper marginal parts 2*a* and 3*a* of the left and right side surface covers 2 and 3 in the direction orthogonal to the direction of the rotating axis L of the workpiece W, and is disposed so as to cover the machining region S.

The lower cover 62 is a funnel-shaped cover member that is disposed under the left side surface cover 2 and the right side surface cover 3 and collects the grinding fluid that falls to the lower part of the machining region S. Further, the lower cover 62 is joined to lower marginal parts 2*b* and 3*b* of the left and right side surface covers 2 and 3 in the direction orthogonal to the direction of the rotating axis L of the workpiece W, and is disposed so as to cover the machining region S.

In addition, the grinding fluid collected by the lower cover 62 is fed from a collecting tray 62*a* (FIG. 1) to a grinding fluid processing apparatus not shown for reproduction.

As shown in FIGS. 2 and 3, the grinding stone table 14 is a device that transmits a driving force from a driving device such as a motor M (see FIG. 2) via a belt BL or the like to rotate the grinding stone G attached to the grinding head 14*a*, and is mounted on the X axis saddle 15.

Note that in the embodiments, the grinding stone G is rotated via the belt BL or the like. However, it may be directly driven by a built-in motor.

The X axis saddle 15 is disposed so as to be movable by the X axis feeding device 15*a* along the advancing/retracting direction (X axis direction) in which the advancing/retracting operations are performed with respect to the workpiece W. The Z axis saddle 16 is disposed such that the grinding stone table 14 is movable by the Z axis feeding device 16*a* along the direction of the rotating axis L (Z axis direction) of the workpiece W. Further, the Z axis saddle 16 has the X axis feeding device 15*a* and the X axis saddle 15 mounted thereon.

With this configuration, the Z axis saddle 16 has the X axis saddle 15 mounted thereon. Therefore, when the Z axis saddle 16 is moved by the Z axis feeding device 16*a* along the direction of the rotating axis L (Z axis direction) of the workpiece W, the X axis saddle 15 and the grinding stone table 14 can be moved in the Z axis direction.

In addition, when the X axis saddle 15 is moved by the X axis feeding device 15*a* along the advancing/retracting direction (X axis direction) in which the advancing/retracting operations are performed with respect to the workpiece W, only the grinding stone table 14 can be moved in the X axis direction.

Note that the X axis feeding device 15*a* and the Z axis feeding device 16*a* are each composed of a linear guiding mechanism and a rotary feeding mechanism (not shown) that uses ball screws, nuts, or the like. However, the present invention is not particularly limited to the configurations of the feeding devices, and thus their detailed descriptions will be omitted.

As shown in FIGS. 2 and 3, the grinding stone cover 18 is a substantially rectangular container-shaped cover member that is fixed to the Z axis saddle 16 by bolts 18*f* (see FIG. 3) and has an opening part 18 on the front side thereof that opens into the machining region S so as to cover the back surface side thereof with respect to the workpiece W of the disc-shaped grinding stone G.

With this configuration, the grinding stone cover 18 is not fixed to the grinding stone table 14 mounted on the X axis saddle 15 but is fixed to the Z axis saddle 16. Therefore, when the X axis saddle 15 is moved by the X axis feeding device 15*a* along the X axis direction, only the grinding stone table 14 moves in the X axis direction with the grinding stone cover 18 remaining at rest and only the grinding stone G enters the machining region S via the opening part 18*a* of the grinding stone cover 18 to perform the grinding machining of the workpiece W (see FIG. 4)

Thus, since the scattering prevention structure 1 according to the embodiments of the present invention is not required to move the grinding stone head 14*a* into the machining region S, it can improve the shielding performance and reduce the size of the machining chamber S'.

As shown in FIG. 2, the grinding stone cover 18 includes a first side plate 18*b* that serves as a base and has prescribed rigidity, a second side plate 18*c* that faces the first side plate 18*b* and has a grinding stone attaching hole 18*d* (see also FIG. 3), the accordion cover 5 attached to the first side plate 18*b*, and a cover member 18*e* that covers the grinding stone attaching hole 18*d*.

As shown in FIG. 3, the accordion cover 5 is a so-called round accordion having a circular outer shape and includes a ring-shaped outer frame body 5*a* adhered to the outer peripheral part thereof, an expanding/contracting part 5*b* in which peaks and valleys are successively formed in a pleated fashion so as to concentrically spread in the outer diameter direction, and a fitting hole 5*c* (see FIG. 2) in which the grinding stone head 14*a* fits.

The accordion cover 5 is attached to the first side plate 18*b* of the grinding stone cover 18 such that the grinding stone head 14*a* having the grinding stone G attached thereto fits in the accordion cover 5, and is attached between the grinding stone head 14*a* and the grinding stone cover 18 such that the grinding stone head 14*a* is movable in the advancing/retracting direction with respect to the workpiece W (see FIG. 2).

Note that the embodiments include but not limited to the round accordion as the accordion cover 5. Alternatively, various modes such as accordion covers, telescopic covers, and winding covers having various forms capable of expanding/contracting in the X axis direction can be employed so long as the grinding stone head 14*a* can be movably attached in the X axis direction.

The Z axis shielding cover 4 includes a first Z axis shielding cover 41 that is attached along the direction perpendicular to the first side plate 18*b* of the grinding stone cover 18 and made of a rectangular flat plate member and a second Z axis shielding cover 42 that is attached along the direction perpendicular to the second side plate 18*c* of the grinding stone cover 18 and made of a rectangular flat plate member.

The first Z axis shielding cover 41 is disposed on the left side of the opening part 18*a* such that one side of the first Z axis shielding cover 41 in the up and down direction comes into contact with the opening part 18*a* of the grinding stone cover 18, and shields the left side surface cover 2 and the left side of the opening part 18*a* of the grinding stone cover 18 one from the other such that the first Z axis shielding cover 41 slidably comes into contact with the left side surface cover 2 via a scraper or the like not shown.

The second Z axis shielding cover 42 is disposed on the right side of the opening part 18*a* such that one side of the second Z axis shielding cover 42 in the up and down direction comes into contact with the opening part 18*a* of the grinding stone cover 18, and shields the right side surface cover 3 and the right side of the opening part 18*a* of the grinding stone cover 18 one from the other such that the second Z axis shielding cover 42 slidably comes into contact with the right side surface cover 3 via a scraper or the like not shown.

Note that the embodiments include but not limited to the Z axis shielding cover 4 composed of the non-expanding/contracting rectangular flat plate member. Alternatively, various modes such as accordion covers, telescopic covers, and winding covers capable of expanding/contracting in the Z axis direction can be employed so long as the left side surface cover 2, the right side surface cover 3, and the grinding stone cover 18 are shielded one from another and the grinding stone cover 18 is movably attached in the rotating axis direction of the workpiece W.

Figure 4:
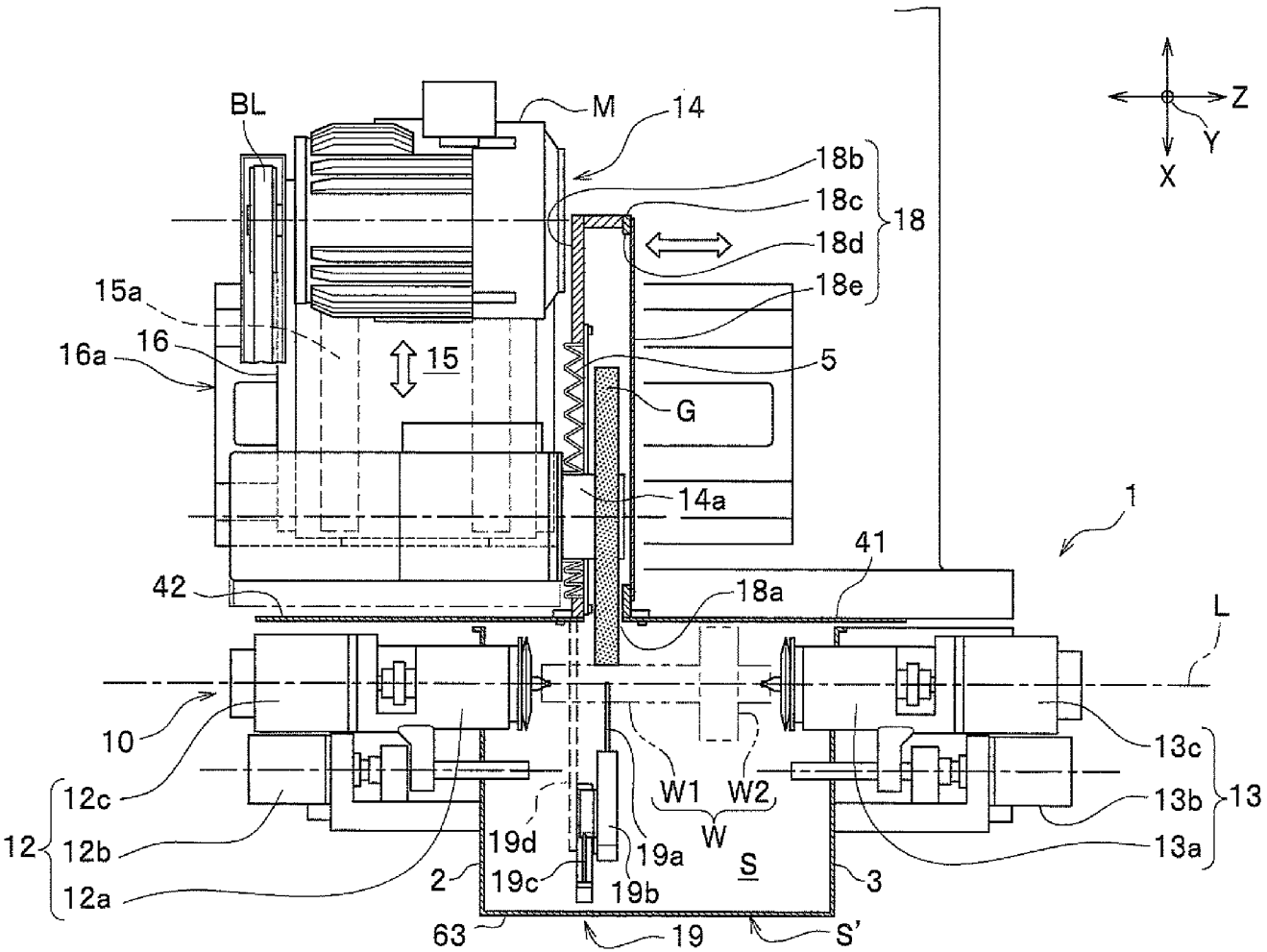
FIG. 4 is a partial plan view of FIG. 1 for describing operations in the scattering prevention structure of the grinding machine according to the embodiments of the present invention and shows a state in which a grinding stone head is moved in the directions of Z and X axes from the state shown in FIG. 2.

As shown in FIGS. 3 and 4, the sizing device 19 includes a main body part 19*b* having a probe 19*a* that measures the grinding portion W1 of the workpiece W and the moving means 19*c* for advanceably/retractably moving the main body part 19*b* with respect to the workpiece W, and is fixed to the first side plate 18*b* of the grinding stone cover 18 via a supporting column 19*d* (see also FIG. 2).

The sizing device 19 can measure the grinding portion W1 of the workpiece W in such a manner that the main body part 19*b* is caused to come close to the workpiece W by the moving means 19*c* and the end of the workpiece W is held by the probe 19*a*. Further, during the grinding machining of the grinding stone G, the sizing device 19 can measure the grinding portion W1 of the workpiece W while the grinding stone G is moved in the Z axis direction by the Z axis feeding device 16*a* (see FIG. 3).

At this time, even if the grinding stone G is moved in the X axis direction by the X axis feeding device 15*a* (see FIG. 3), the sizing device 19 fixed to the grinding stone cover 18 does not move in the X axis direction. Therefore, the measuring device 19 can measure the grinding portion W1 of the workpiece W without suffering from the movement of the grinding stone G in the X axis direction.

In addition, if a protruding interference part such as a collar W2 having a diameter greater than that of the grinding portion W1 of the workpiece W is formed, the moving means 19*c* of the sizing device 19 is separately operated by a controlling device not shown to retract the sizing device 19 so as to be distant from the workpiece W. Thus, the interference between the probe 19*a* and the collar W2 can be prevented.

Next, the scattering prevention structure 1 according to the embodiments of the present invention configured as described above produces the following functions and effects.

That is, with the simple configuration using the Z axis shielding covers 4 (41 and 42) that shield the left side surface cover 2, the right side surface cover 3, and the grinding stone cover 18 one from another, the scattering prevention structure 1 can define the machining region S only at the peripheral region of the workpiece W. Therefore, the scattering prevention structure 1 can reduce the size of the machining chamber S'.

Moreover, since the accordion cover 5 that serves as the X axis shielding cover attached to the grinding stone cover 18 is disposed separately from the Z axis shielding covers 4 (41 and 42) such that the grinding stone head 14*a* fits in the accordion cover 5, the scattering prevention structure 1 can improve the shielding performance in the X axis direction without hindering the movement of the grinding stone head 14*a* while preventing the interference between the accordion cover 5 and the grinding stone G or the like.

Thus, the scattering prevention structure 1 of the grinding machine 10 according to the embodiments of the present invention can be suitably applied to the grinding machine 10 that reduces the size of the machining chamber S', in which the grinding fluid is scattered, with the simple configuration, improves the shielding performance while preventing the adverse effects of heat, and has the devices (15*a* and 16*a*) that biaxially feed the grinding stone G.

The embodiments of the present invention are described above. However, the present invention is not limited to the respective embodiments described above and may be appropriately modified to be implemented.

For example, the embodiments are applied to the horizontal grinding machine 10 having the main axis table 12 and the tailstock 13, but may be similarly applied to a vertical grinding machine 10 in which the direction of the rotating axis of the grinding stone G is different.

EXPLANATION OF REFERENCES

1: scattering prevention structure
2: left side surface cover
3: right side surface cover
4: Z axis shielding cover
5: accordion cover
10: grinding machine
12: main axis table
13: tailstock
14: grinding stone table
14*a*: grinding stone head
15: X axis saddle
15*a*: X axis feeding device
16: Z axis saddle
16*a*: Z axis feeding device
18: grinding stone cover
19: sizing device
19*c*: moving means
41: first Z axis shielding cover
42: second Z axis shielding cover
G: grinding stone
L: rotating axis of workpiece
S: machining region
S': machining chamber
W: workpiece
W1: grinding portion

The invention claimed is:

1. A scattering prevention structure that covers a machining region of a grinding machine having a pair of supporting tables that is disposed facing each other and rotatably supports a workpiece, a grinding stone table having a grinding stone head that rotatably supports a grinding stone, an X axis saddle that movably supports the grinding stone table along an advancing/retracting direction with respect to the workpiece, a Z axis saddle that movably supports the X axis saddle along a rotating axis direction of the workpiece, and a grinding stone cover that covers the grinding stone, the scattering prevention structure comprising:

a first fixing cover and a second fixing cover that are respectively attached to sides where the respective supporting tables face each other;

a Z axis shielding cover that shields the first fixing cover, the second fixing cover, and the grinding stone cover one from another and has the grinding stone cover attached thereto such that the grinding stone cover is movable in the rotating axis direction of the workpiece; and an X axis shielding cover that is attached to the grinding stone cover such that the grinding stone head having the grinding stone attached thereto fits in the X axis shielding cover, shields the grinding stone head and the grinding stone cover one from the other, and has the grinding stone head attached thereto such that the grinding stone head is movable in the advancing/retracting direction with respect to the workpiece, wherein the machining region is covered by the first fixing cover, the second fixing cover, and the Z axis shielding cover to form a machining chamber, the grinding stone cover is fixed to the Z axis saddle such that the grinding stone cover opens into the machining chamber, and the grinding stone head is movable relative to the grinding stone cover via the X axis shielding cover in the advancing/retracting direction with respect to the workpiece.

2. The scattering prevention structure according to claim 1, wherein the X axis shielding cover is an accordion cover.

3. The scattering prevention structure according to claim 1, wherein the Z axis shielding cover is a fixing cover made of a flat plate.

4. The scattering prevention structure according to claim 1, wherein the grinding stone cover has a sizing device attached thereto, the sizing device measuring a grinding portion of the workpiece.

5. The scattering prevention structure according to claim 4, comprising:

moving means for reciprocating the sizing device in the advancing/retracting direction with respect to the workpiece.

6. The scattering prevention structure according to claim 2, wherein the Z axis shielding cover is a fixing cover made of a flat plate.

* * * * *